US005791168A

United States Patent [19]

Smock et al.

[11] Patent Number: 5,791,168

[45] Date of Patent: Aug. 11, 1998

[54] APPARATUS FOR DIVERTING A FLOW OF WATER IN A WASHING MACHINE

[75] Inventors: Steve W. Smock, Marion County; Richard L. Moore, Johnson County, both of Ind.

[73] Assignee: Emerson Electric Co., St. Louis, Mo.

[21] Appl. No.: 740,545

[22] Filed: Oct. 30, 1996

[51] Int. Cl.[6] ..... D06F 39/02

[52] U.S. Cl. ..... 68/12.18; 68/17 R; 137/624.2; 222/651

[58] Field of Search ..... 68/12, 18, 17 R; 134/99.2; 137/624.2, 625.11, 625.47; 222/651

[56] References Cited

U.S. PATENT DOCUMENTS

| | | | |
|---|---|---|---|
| 1,044,479 | 11/1912 | Blair | 137/625.11 |
| 2,612,341 | 9/1952 | Bridgefield | 137/625.11 |
| 3,542,072 | 11/1970 | Harris, Sr. et al. | 137/625.47 |
| 3,567,076 | 3/1971 | Zanussi | 222/144 |
| 3,952,556 | 4/1976 | Gakhar et al. | 68/12 R |
| 4,009,598 | 3/1977 | Bernard et al. | 68/12 R |
| 4,043,158 | 8/1977 | Bochan | 68/17 R |
| 4,111,011 | 9/1978 | Waugh | 68/17 R |
| 4,203,307 | 5/1980 | Obata et al. | 68/17 R |
| 4,429,717 | 2/1984 | Montgomery | 137/625.47 |
| 4,960,139 | 10/1990 | Rizzetto | 68/17 R X |
| 5,014,211 | 5/1991 | Turner | 364/478 |
| 5,082,022 | 1/1992 | Boundy | 137/624.2 X |
| 5,584,327 | 12/1996 | Thomas et al. | 137/625.11 X |

FOREIGN PATENT DOCUMENTS

| | | | |
|---|---|---|---|
| 1938880 | 7/1980 | Germany | 68/17 R |

*Primary Examiner*—Philip R. Coe
*Attorney, Agent, or Firm*—Mark D. Becker

[57] ABSTRACT

An automatic washing machine includes a wash tub and a dispenser compartment which is connected to the wash tub. The washing machine further includes a valve assembly having a housing and a rotatable valve member, the housing having (1) a water inlet port defined therein which is connected to a main water line, and (2) a first water outlet port defined therein which is connected to the dispenser compartment, the rotatable valve member (1) disabling a flow of water from the water inlet port to the first water outlet port when the rotatable valve member is positioned at a first valve position, and (2) enabling the flow of water from the water inlet port to the first water outlet port when the rotatable valve member is positioned at a second valve position. Moreover, the washing machine includes a timer mechanism having a rotatable shaft which is positionable at a first shaft position and a second shaft position, the rotatable valve member being positioned at the first valve position when the rotatable shaft is positioned at the first shaft position, and further the rotatable valve member being positioned at the second valve position when the rotatable shaft is positioned at the second shaft position.

21 Claims, 18 Drawing Sheets

| Position of Rotatable Shaft 15 | Position of Rotor 72 | Conduit which is in Fluid Communication with Conduit 26 |
|---|---|---|
| First Shaft Position | First Valve Position | Conduit 30 |
| Second Shaft Position | Second Valve Position | Conduit 38 |
| Third Shaft Position | Third Valve Position | Conduit 42 |
| Fourth Shaft Position | Fourth Valve Position | Conduit 46 |

FIG. 5

| Position of Rotatable Shaft 15 | Position of Rotor 142 | Conduit which is in Fluid Communication with Conduit 26 |
|---|---|---|
| First Shaft Position | First Valve Position | Conduit 30 |
| Second Shaft Position | Second Valve Position | Conduit 30 and 38 |
| Third Shaft Position | Third Valve Position | Conduit 38 |
| Fourth Shaft Position | Fourth Valve Position | Conduit 38 and 46 |
| Fifth Shaft Position | Fifth Valve Position | Conduit 46 |
| Sixth Shaft Position | Sixth Valve Position | Conduit 46 and 42 |
| Seventh Shaft Position | Seventh Valve Position | Conduit 42 |
| Eighth Shaft Position | Eighth Valve Position | Conduit 42 and 30 |

FIG. 15

| Position of Rotatable Shaft 15 | Position of Rotatable Valve Member 196 | Conduit which is in Fluid Communication with Conduit 26 |
|---|---|---|
| First Shaft Position | First Valve Position | Conduit 30 |
| Second Shaft Position | Second Valve Position | Conduit 30 and 38 |
| Third Shaft Position | Third Valve Position | Conduit 38 |
| Fourth Shaft Position | Fourth Valve Position | Conduit 38 and 46 |
| Fifth Shaft Position | Fifth Valve Position | Conduit 46 |
| Sixth Shaft Position | Sixth Valve Position | Conduit 46 and 42 |
| Seventh Shaft Position | Seventh Valve Position | Conduit 42 |
| Eighth Shaft Position | Eighth Valve Position | Conduit 42 and 30 |

FIG. 20

APPARATUS FOR DIVERTING A FLOW OF WATER IN A WASHING MACHINE

BACKGROUND OF THE INVENTION

The present invention generally relates to an apparatus for diverting a flow of water in a washing machine, and more particularly to an apparatus for diverting a flow of water through a dispenser compartment contained in a washing machine.

When using a washing machine, it is desirable that additives be dispensed automatically. For example, it is desirable to be able to automatically dispense various additives such as fabric softener, detergent and bleach into a washing machine wash tub at various times during operation of the washing machine.

When the dispensing of additives is automatic, a user may load articles of clothing to be washed into the wash tub, and then place the additive into the proper dispenser compartment and attend to other activities. The washing machine automatically completes its various cycles of operation while dispensing the required additive at the appropriate time.

When automatically dispensing additives the best results are obtained if the additive is dispensed by flushing a volume of water through the dispensing compartment containing the additive. Dispensing the additive with water in the aforementioned manner dilutes the additives before they come into contact with the clothing. This dilution prevents the additives from damaging the articles of clothing within this wash tub. For example, a "fabric burn" may result if a relatively concentrated volume of bleach comes into contact with an article of clothing. Additionally, dispensing the additives with a volume of water facilitates even distribution of the additive within the wash tub.

Dispensing of additives has heretofore largely depended upon the use of various water valve assemblies or water diverters to direct a flow of water to a dispenser compartment thereby flushing an additive contained therein into the wash tub. However, many existing designs of valve assemblies are relatively mechanically complex thus causing the assembly to be relatively large in size and expensive to manufacture. Moreover, these existing water valve assemblies require a greater amount of maintenance.

It would therefore be desirable to provide an apparatus for diverting a flow of water in a washing machine that is relatively small in size and inexpensive to manufacture. It would further be desirable to provide an apparatus for diverting a flow of water in a washing machine that thus requires less maintenance.

SUMMARY OF THE INVENTION

The above and other objects, features, advantages of the present invention will become apparent from the following description and the attached drawings.

In accordance with one embodiment of the present invention an apparatus for diverting a flow of water in a washing machine having a first dispenser compartment is provided. The apparatus includes a valve assembly including a housing and a rotatable valve member. The housing includes (1) a water inlet port defined therein which is connected to a main water line, and (2) a first water outlet port defined therein which is connected to the first dispenser compartment. The rotatable valve member (1) disables a flow of water from the water inlet port to the first water outlet port when the rotatable valve member is positioned at a first valve position, and (2) enables the flow of water from the water inlet port to the first water outlet port when the rotatable valve member is positioned at a second valve position. The apparatus also includes a timer mechanism having a rotatable shaft which is positionable at a first shaft position and a second shaft position. The rotatable valve member is positioned at the first valve position when the rotatable shaft is positioned at the first shaft position. Furthermore, the rotatable valve member is positioned at the second valve position when the rotatable shaft is positioned at the second shaft position.

In accordance with another embodiment of the present invention there is provided an automatic washing machine. The washing machine includes a wash tub and a dispenser compartment which is connected to the wash tub. The washing machine also has a valve assembly includes a housing and a rotatable valve member. The housing includes (1) a water inlet port defined therein which is connected to a main water line, and (2) a first water outlet port defined therein which is connected to the dispenser compartment. The rotatable valve member (1) disables a flow of water from the water inlet port to the first water outlet port when the rotatable valve member is positioned at a first valve position, and (2) enables the flow of water from the water inlet port to the first water outlet port when the rotatable valve member is positioned at a second valve position. The automatic washing machine also includes a timer mechanism having a rotatable shaft which is positionable at a first shaft position and a second shaft position. The rotatable valve member is positioned at the first valve position when the rotatable shaft is positioned at the first shaft position, and further the rotatable valve member is positioned at the second valve position when the rotatable shaft is positioned at the second shaft position.

It is therefore an object of the present invention to provide a new and useful apparatus for diverting a flow of water in a washing machine.

It is another object of the present invention to provide an improved apparatus for diverting a flow of water in a washing machine.

It is another an object of the present invention to provide a new and useful automatic washing machine.

It is yet another object of the present invention to provide an improved automatic washing machine.

It is still another object of the present invention to provide an apparatus for diverting a flow of water in a washing machine that is relatively small in size and inexpensive to manufacture.

It is another object of the present invention to provide an apparatus for diverting a flow of water in a washing machine that is mechanically less complex.

The above and other objects, features, and advantages of the present invention will become apparent from the following description and attached drawings.

BRIEF DESCRIPTION OF THE INVENTION

Figure 1:
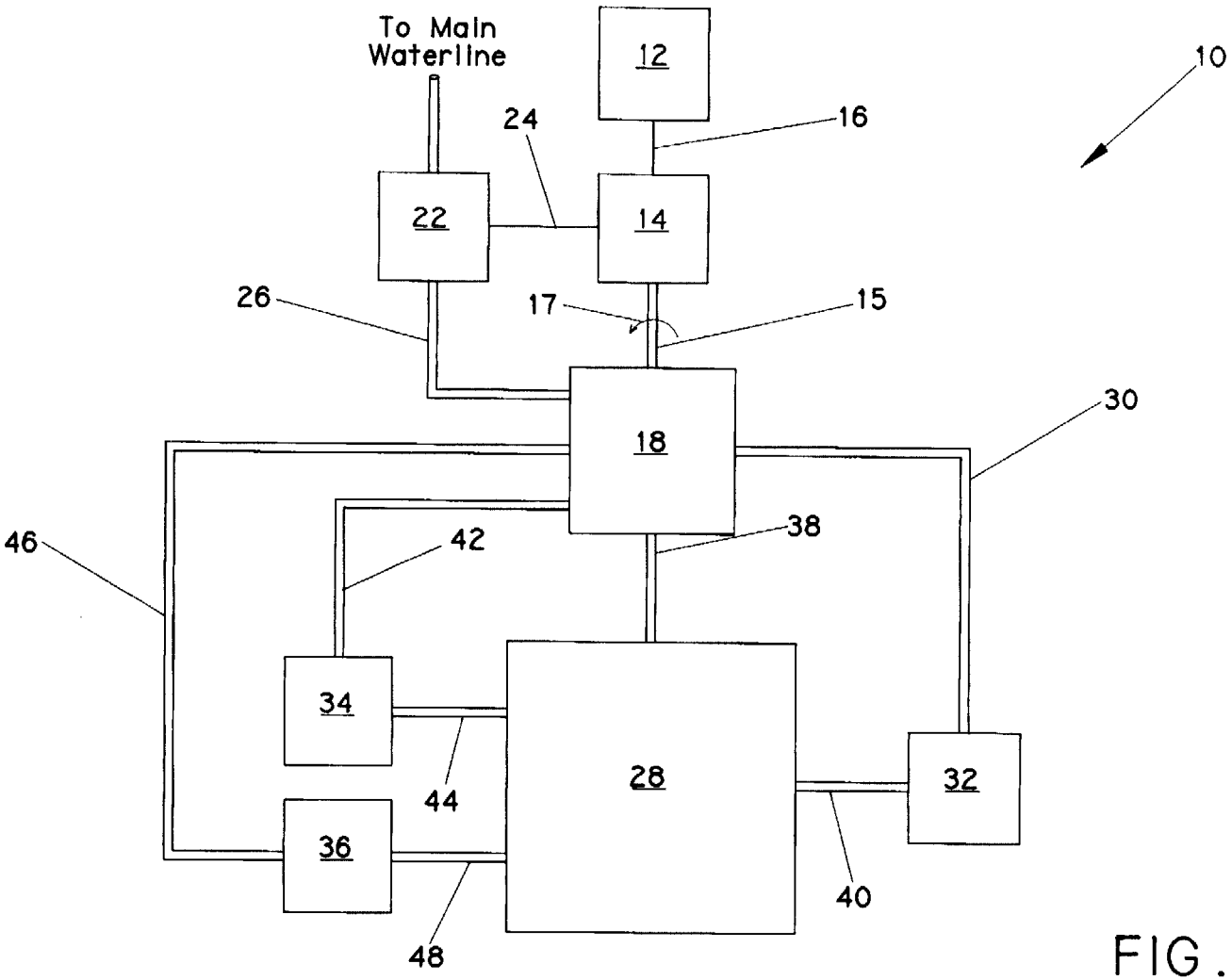
FIG. 1 is a schematic representation of an automatic washing machine which incorporates the features of the present invention therein.
Figure 3:
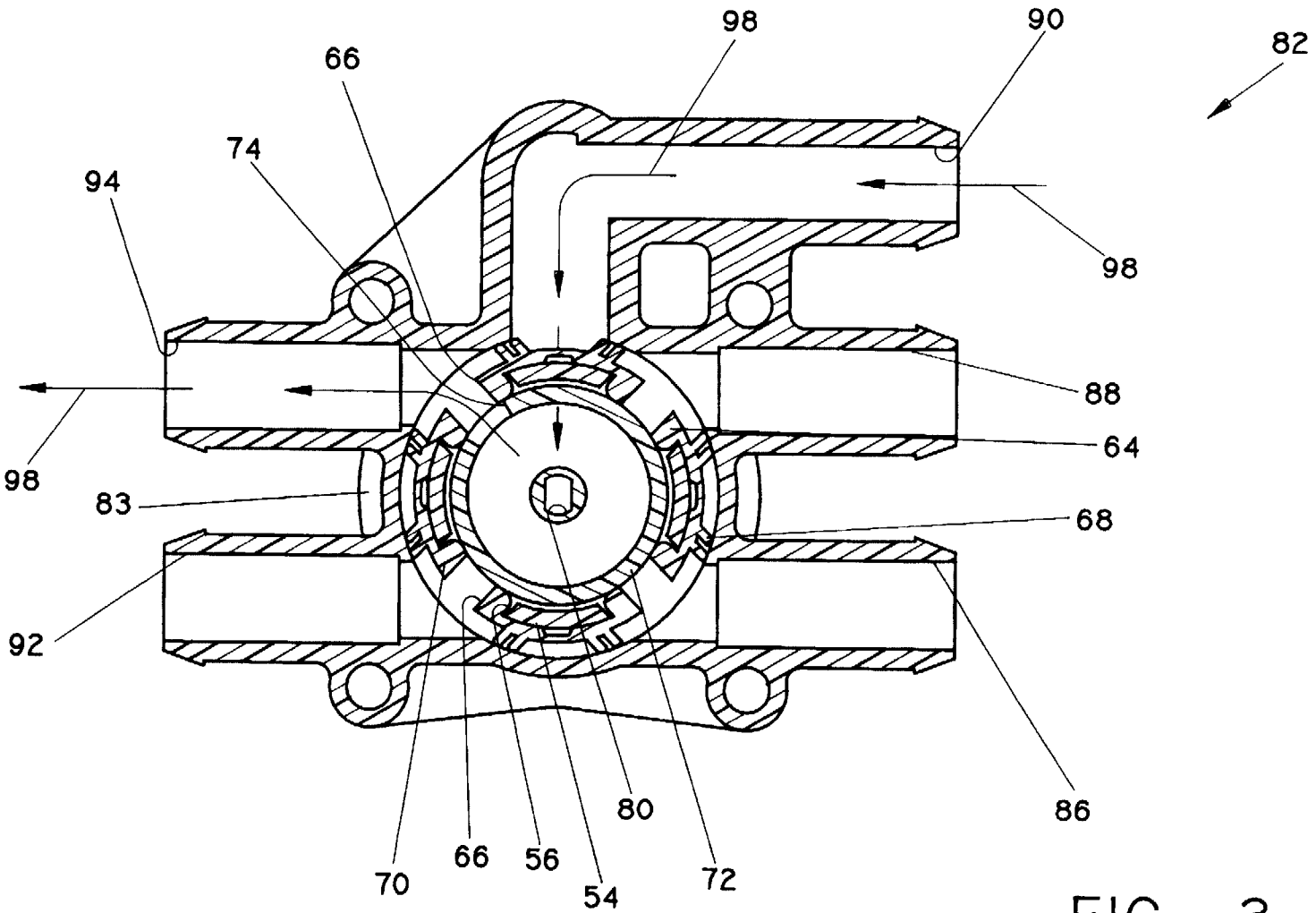
FIG. 3 is a cross sectional view of the valve assembly taken along line 3—3 of FIG. 2, with the rotor of the valve assembly shown positioned at a first valve position.
Figure 4:
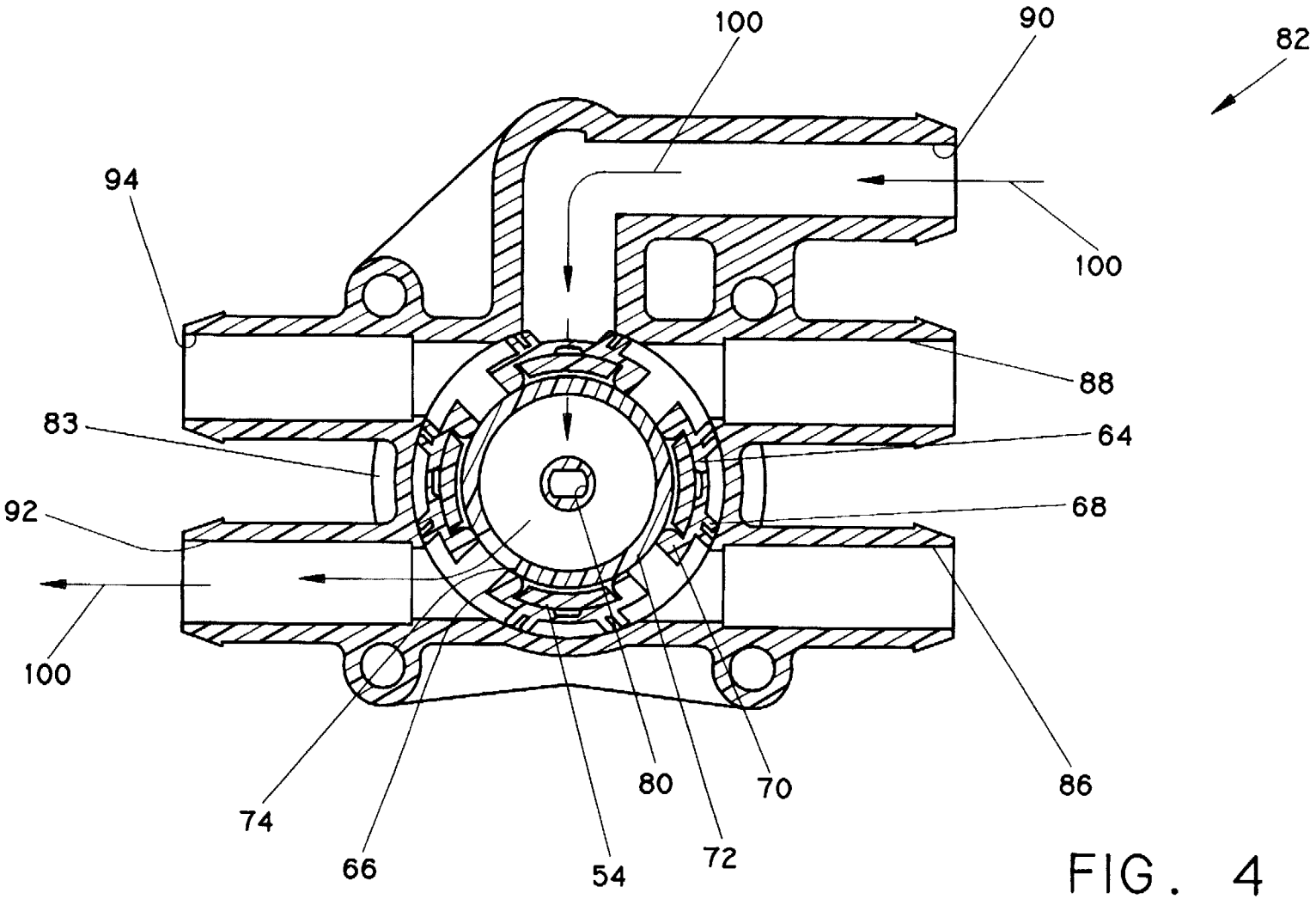
Figure 6:
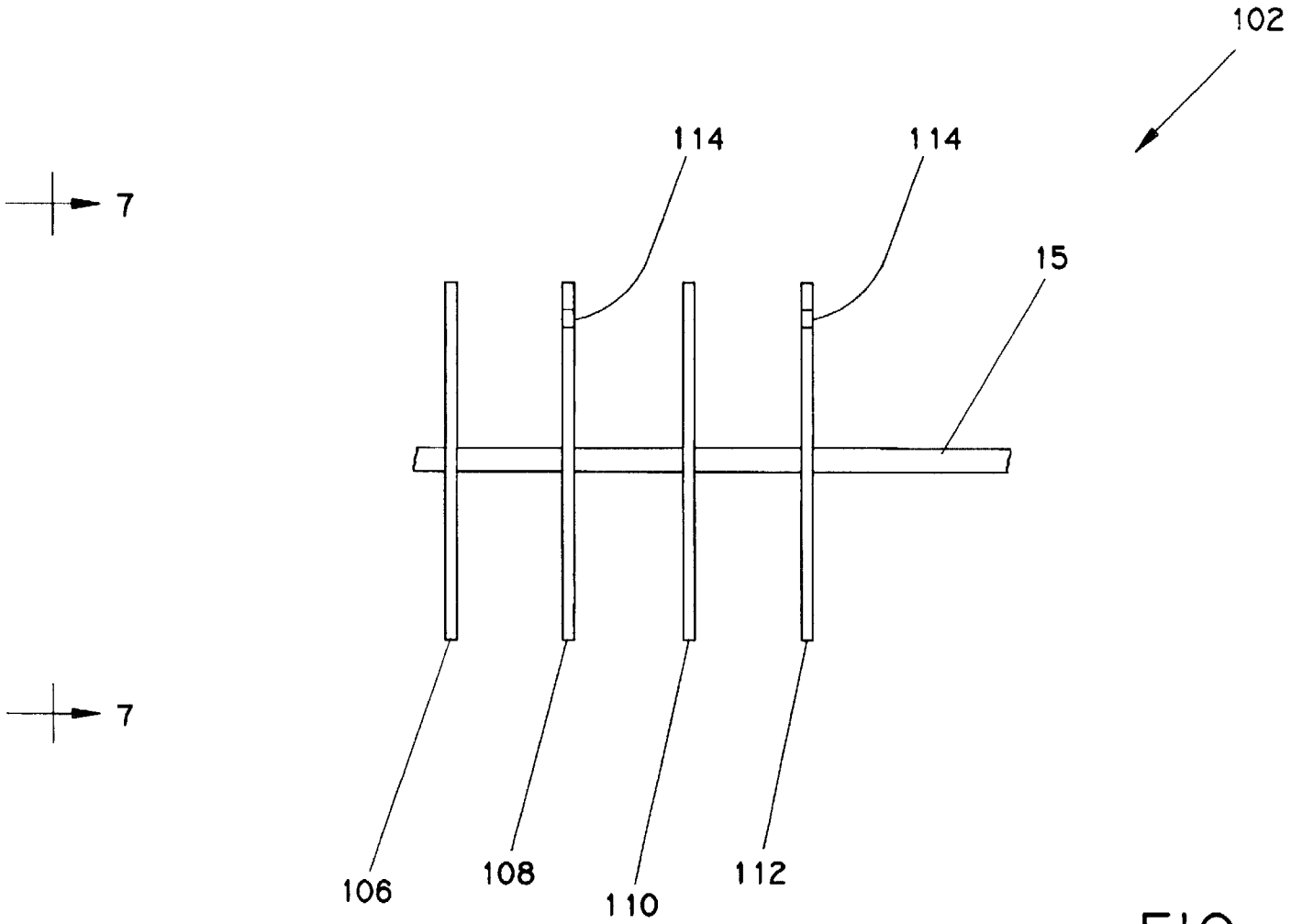
Figure 7:
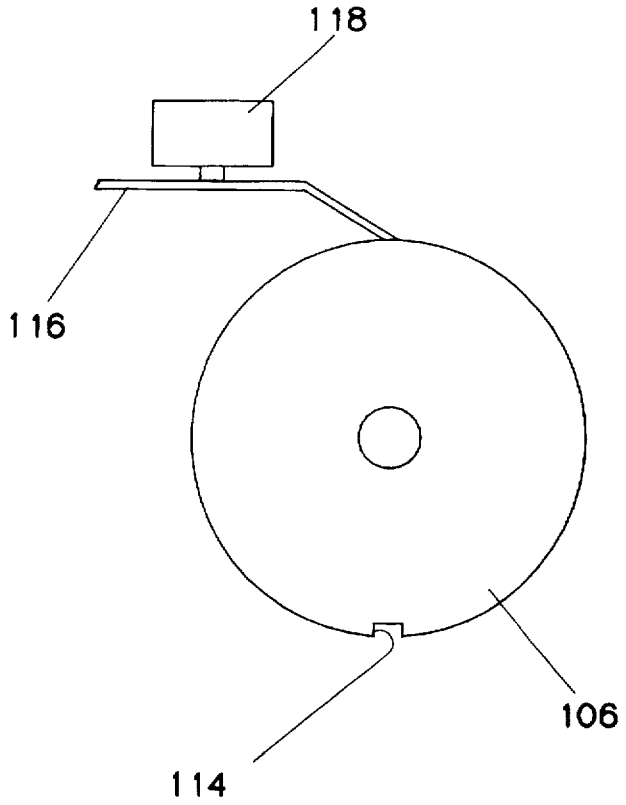
Figure 8:
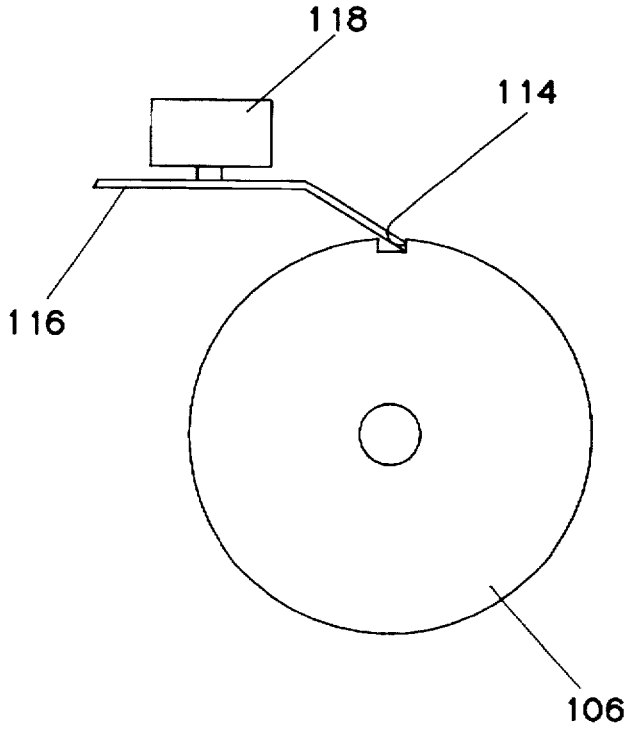
Figure 9:
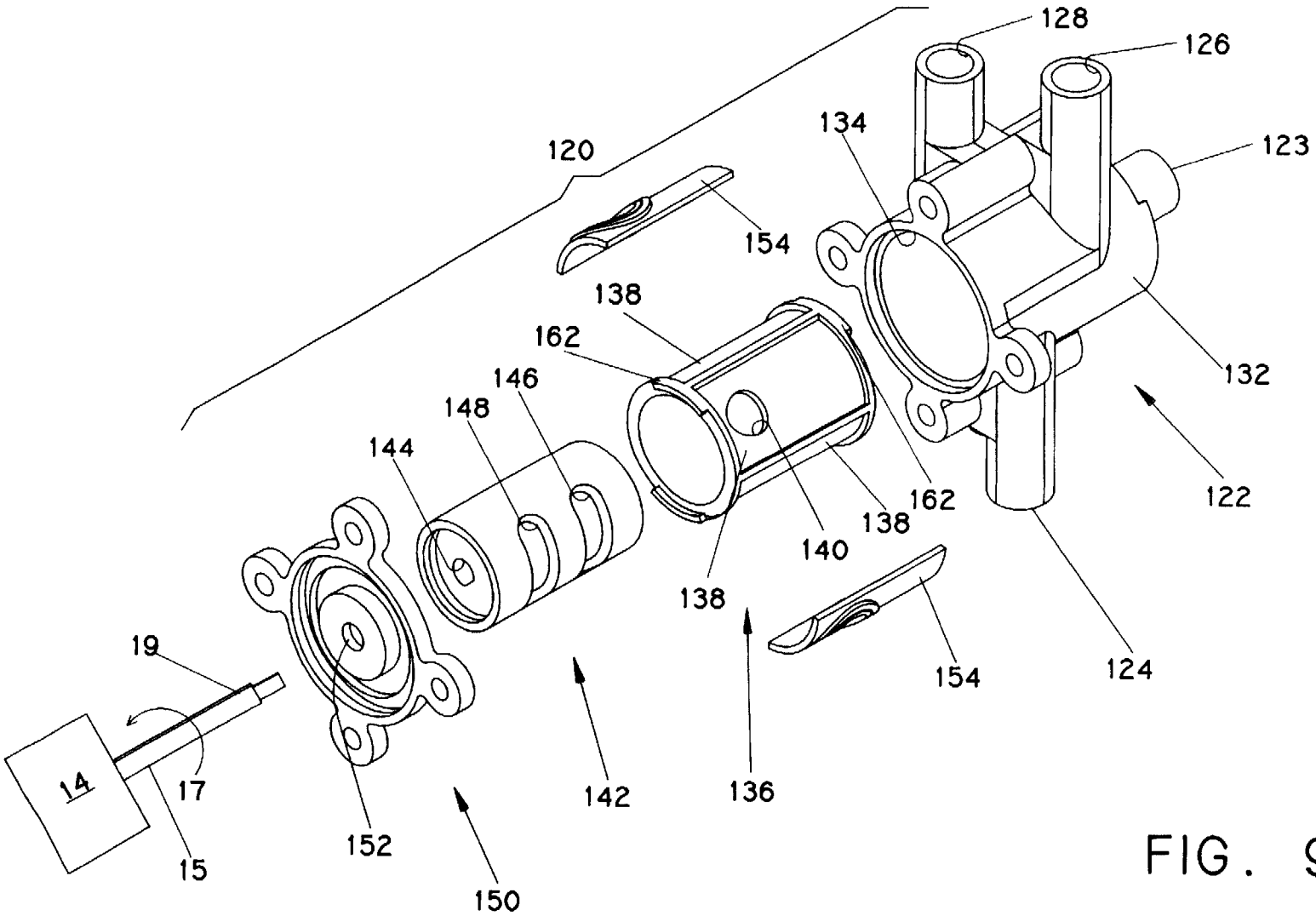
Figure 10:
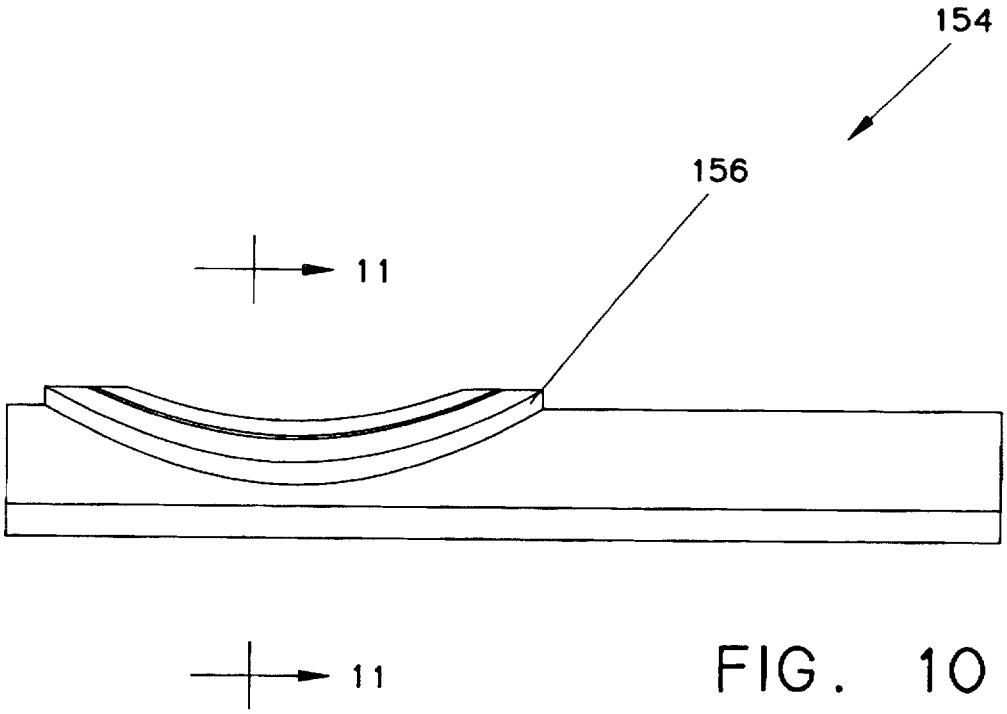
Figure 11:
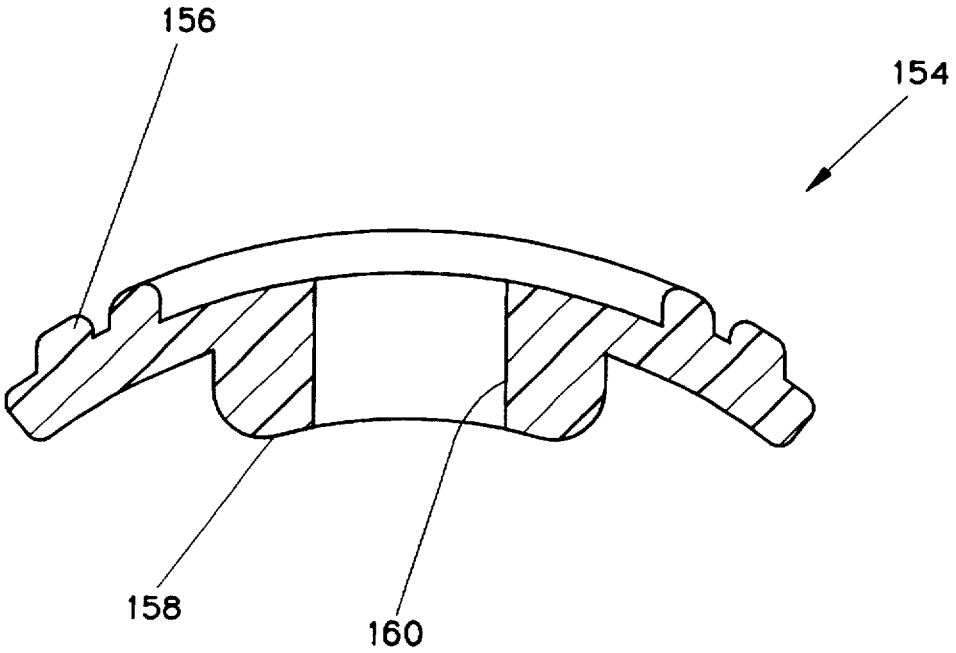
Figure 12:
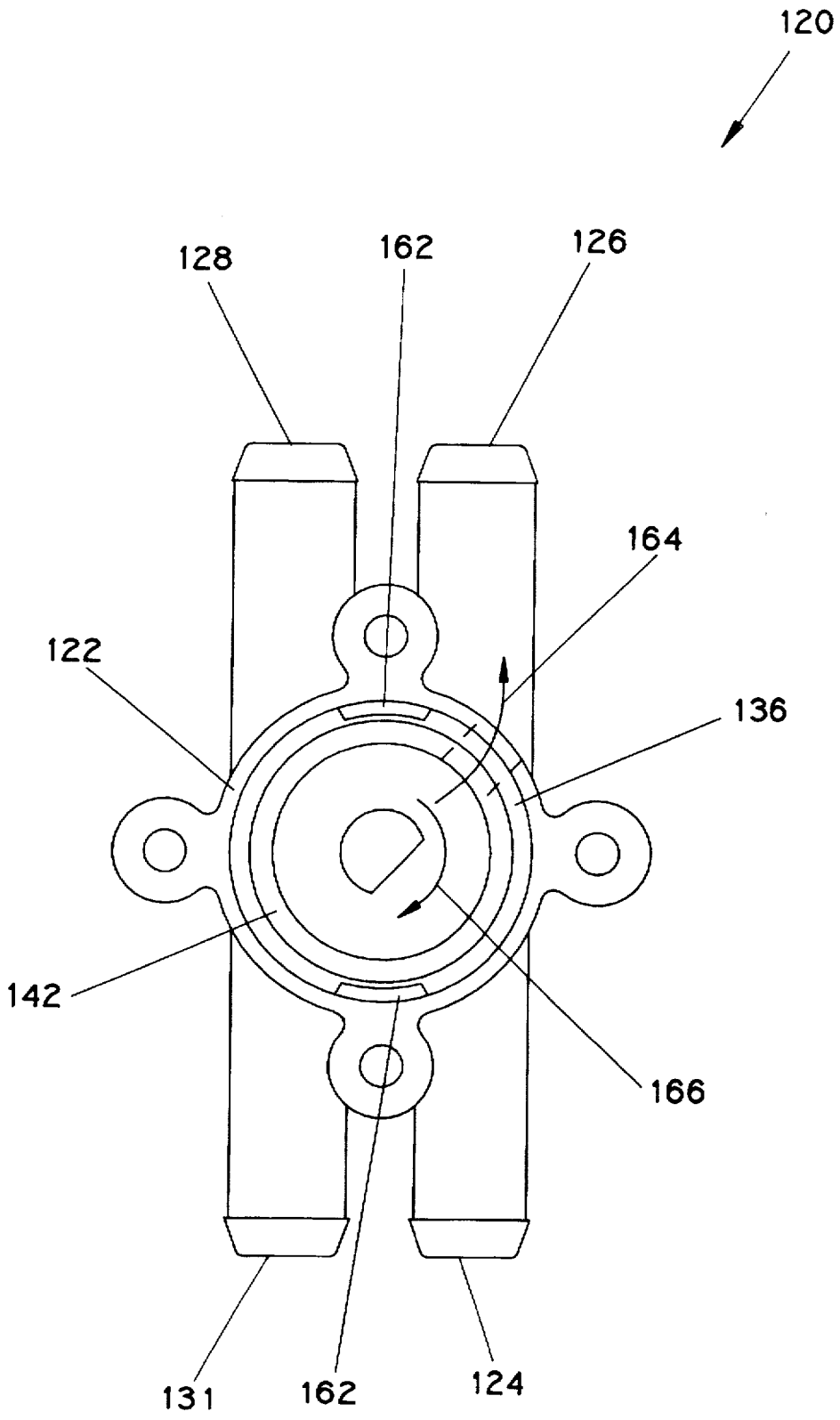
Figure 13:
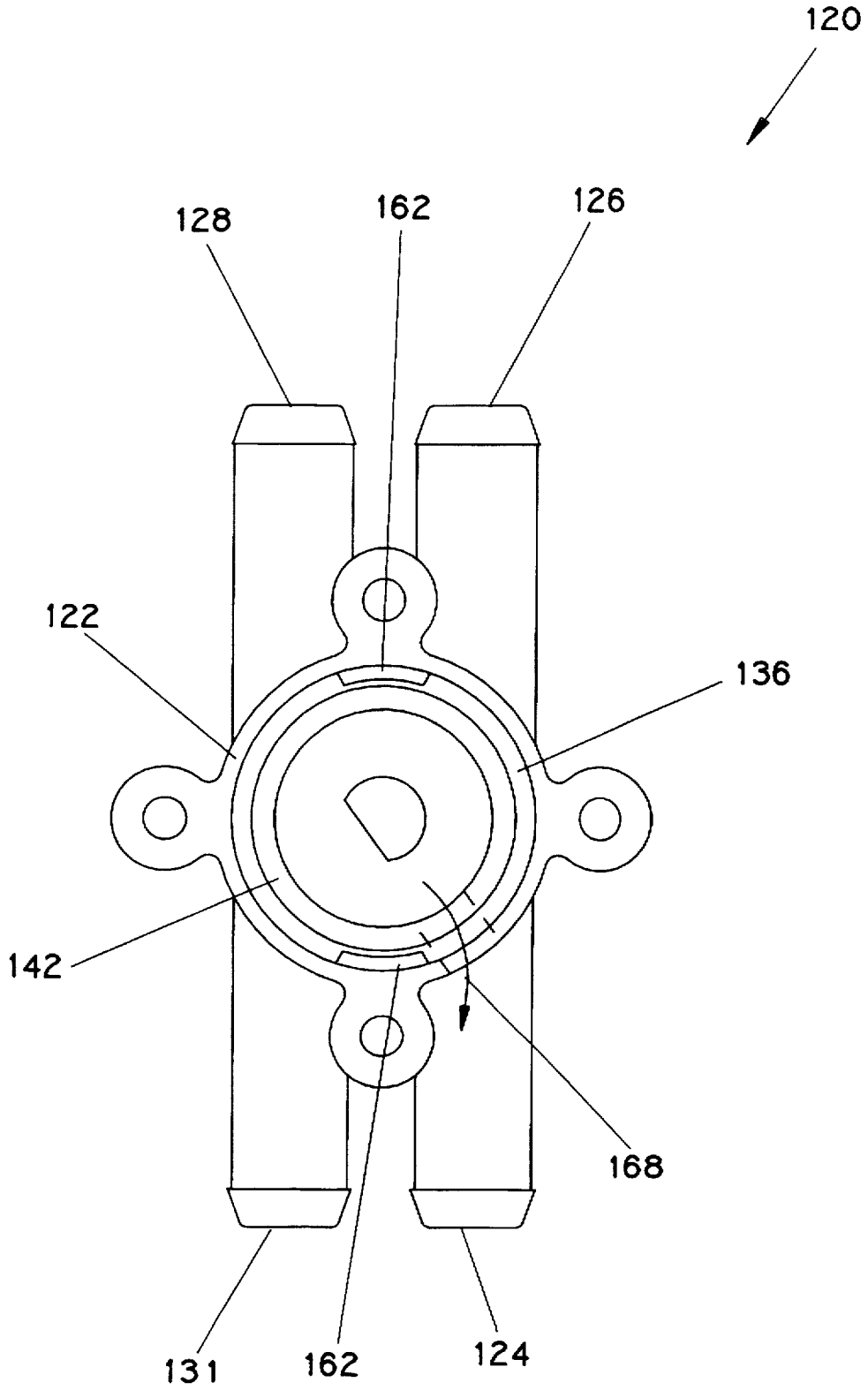
Figure 14:
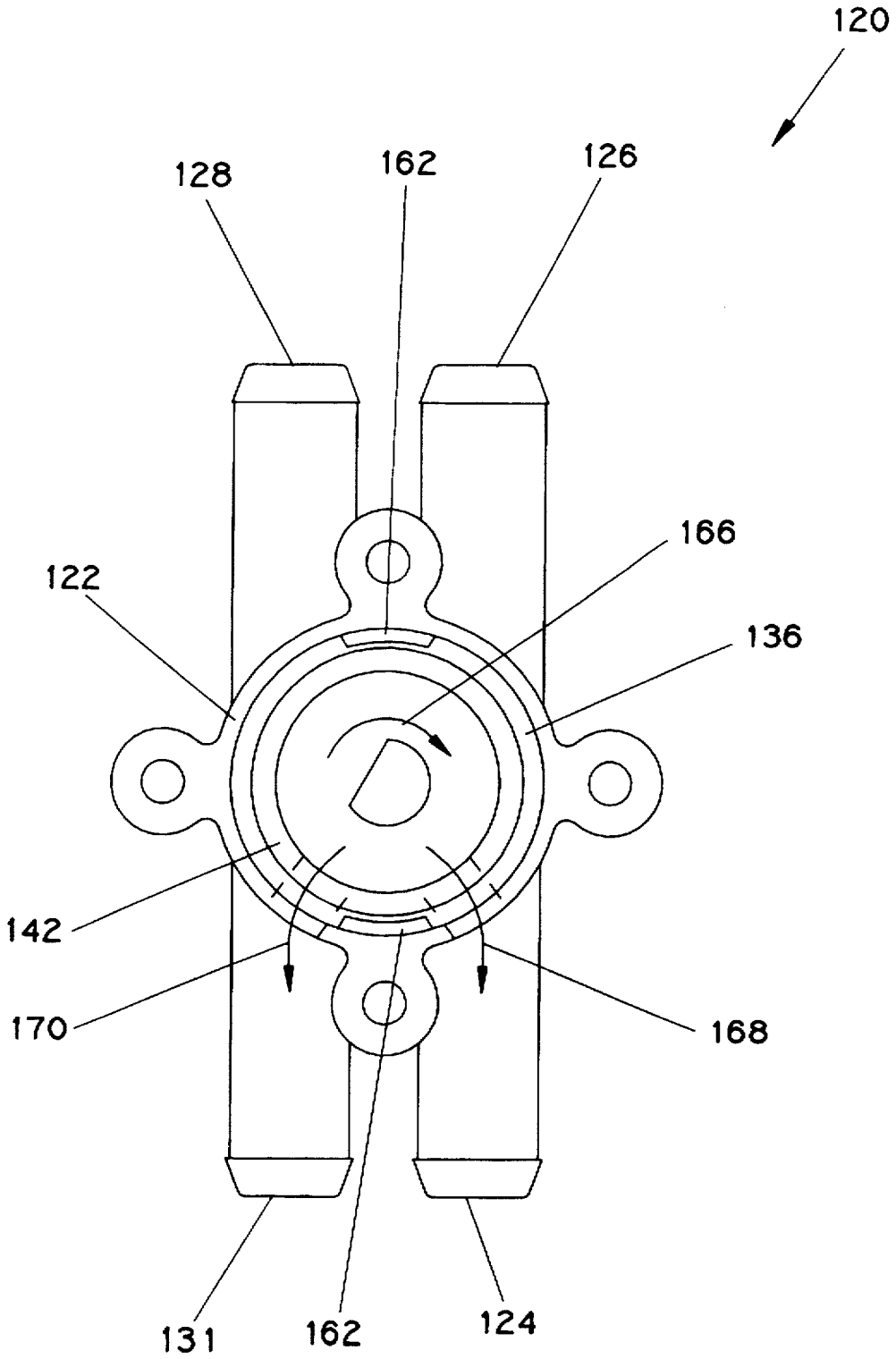
Figure 16:
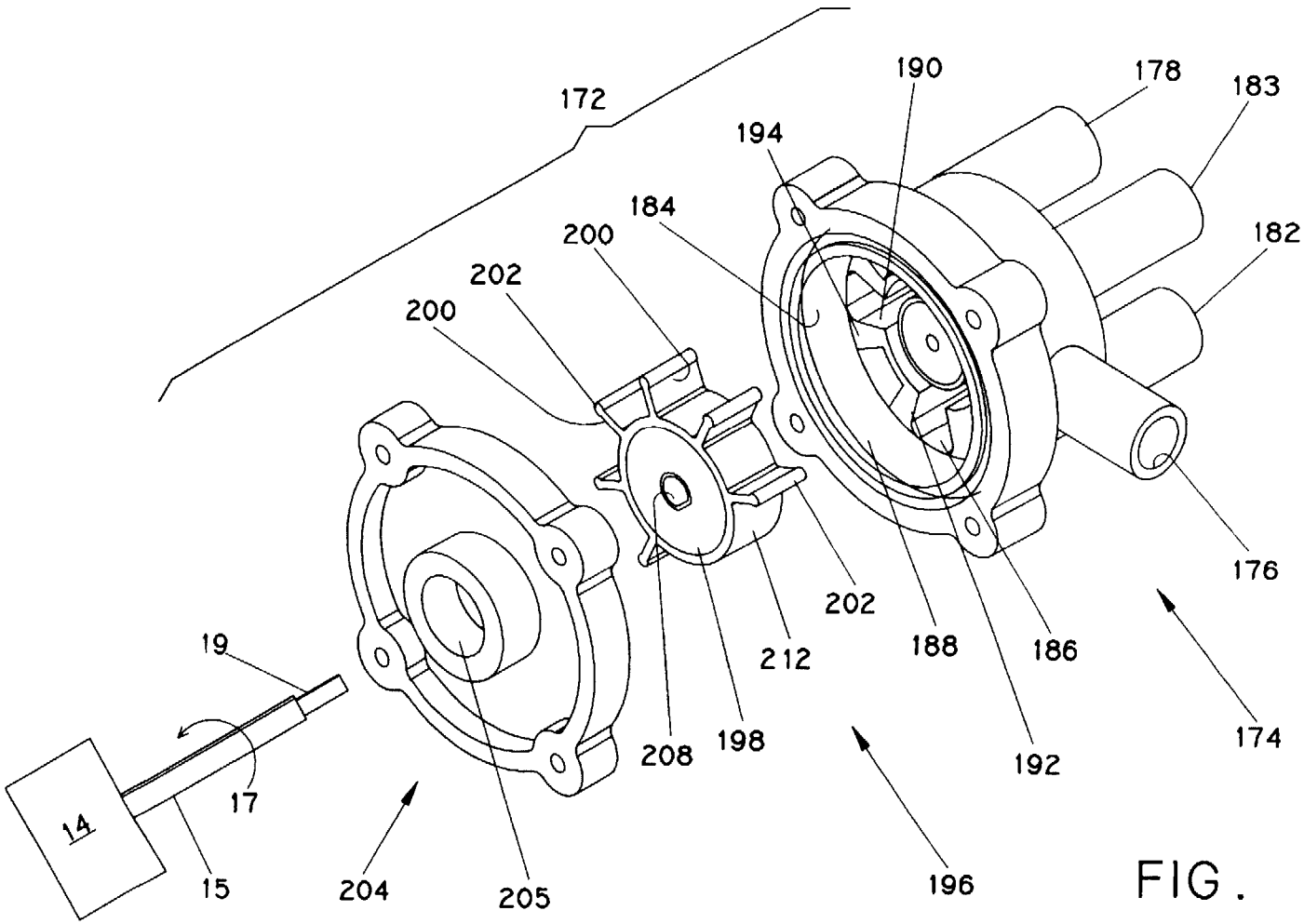
Figure 17:
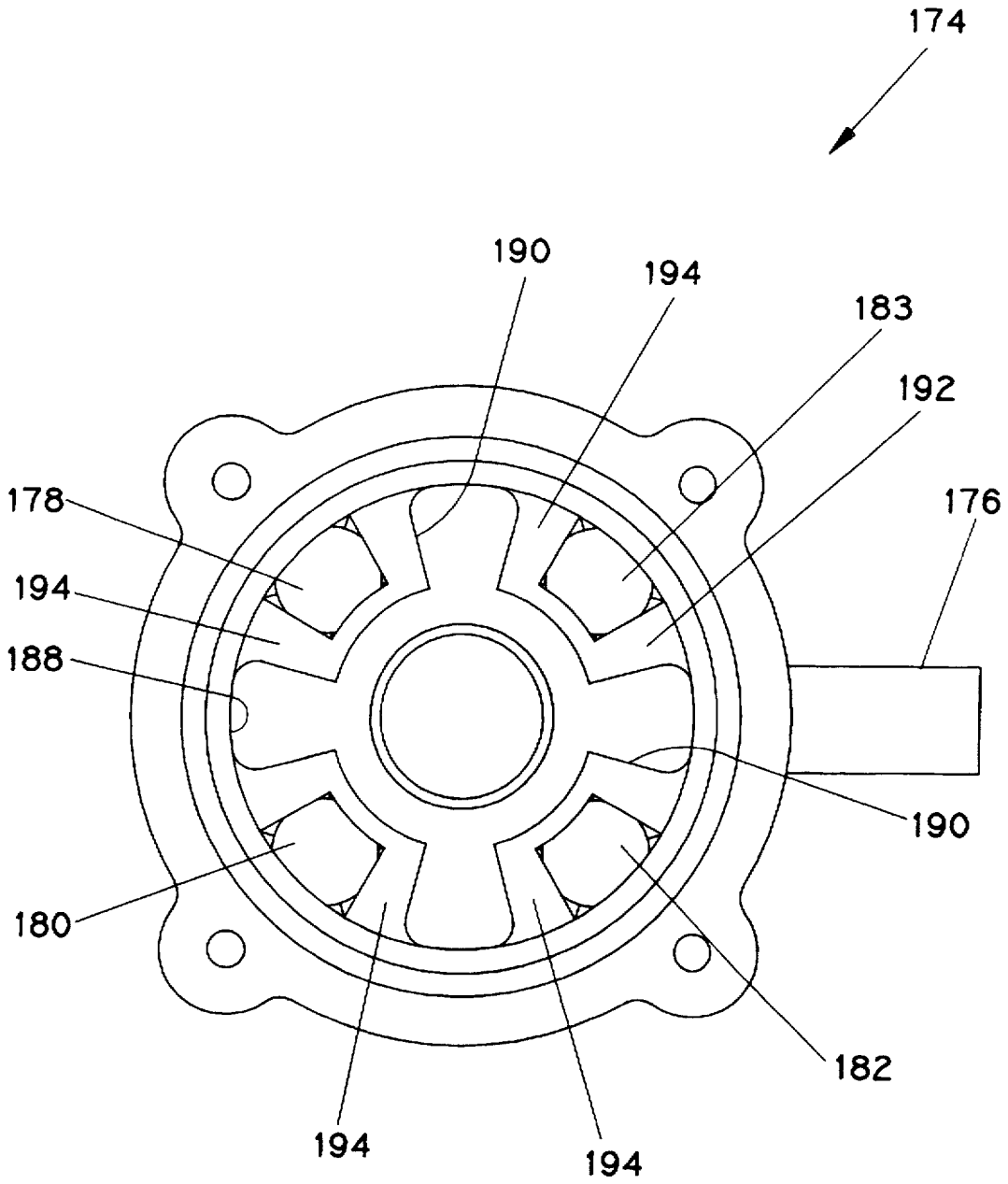
Figure 18:
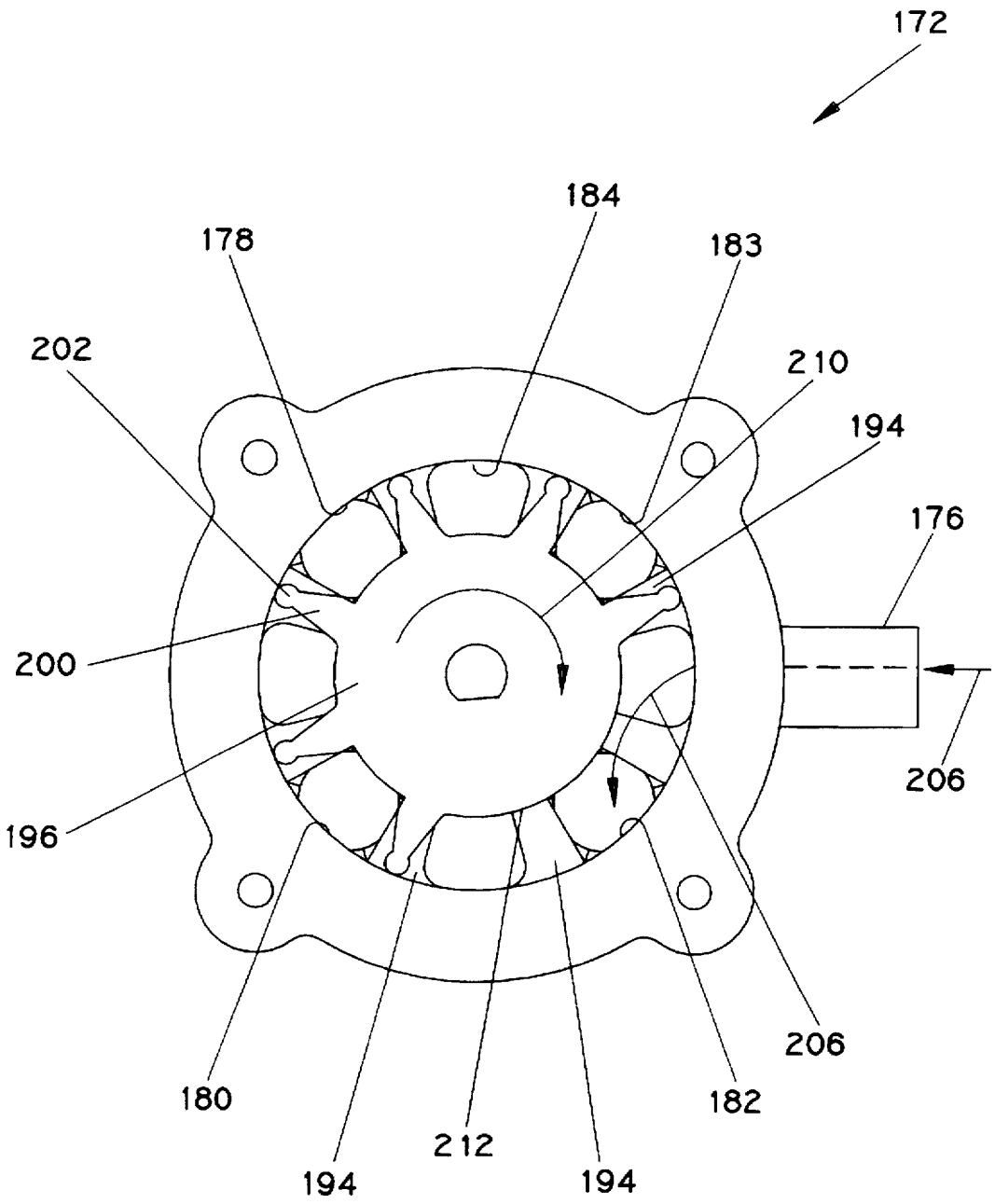
Figure 19:
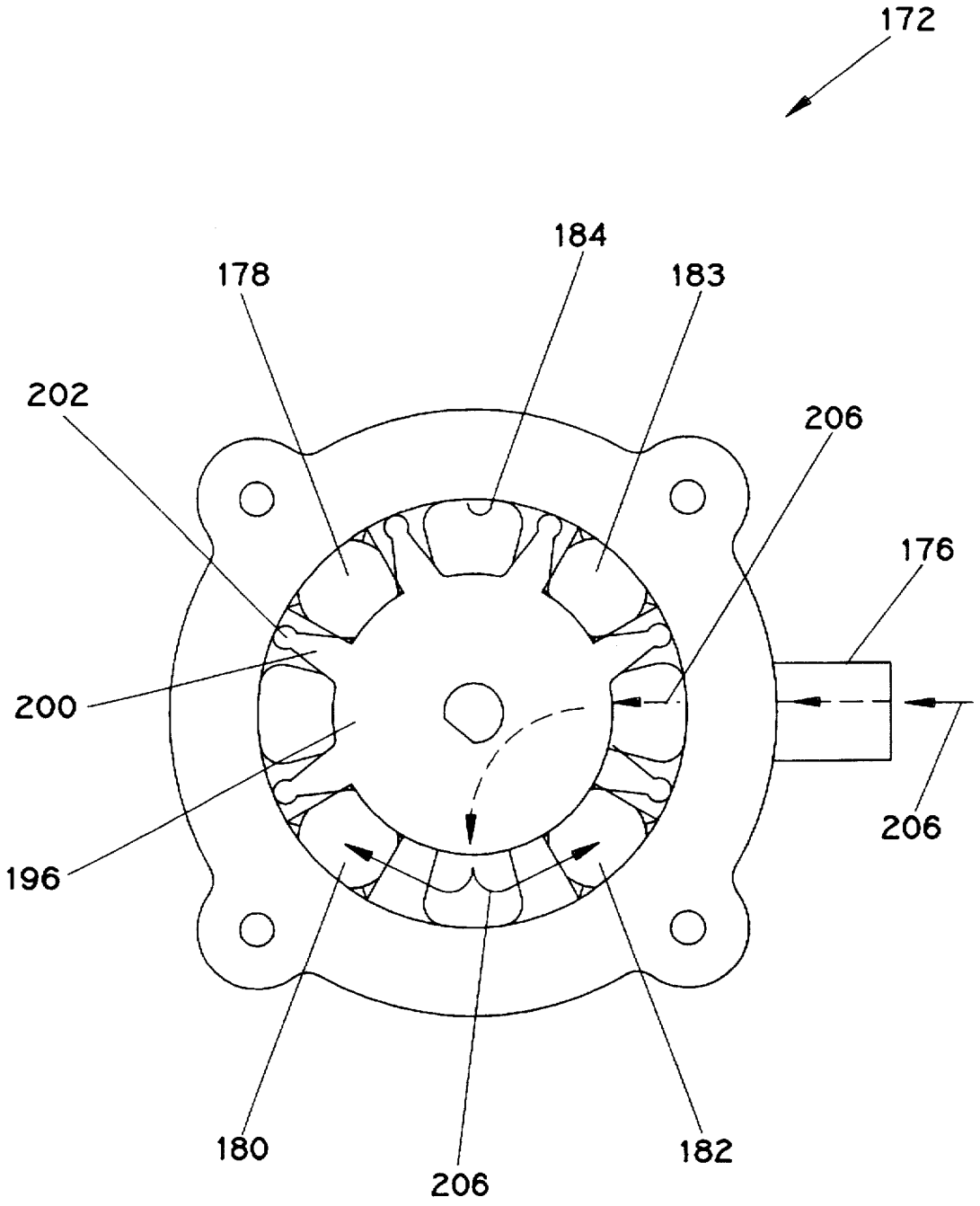

FIG. 4. is a view similar to FIG. 3, but showing the rotor of the valve assembly shown positioned at a second valve position;

FIG. 5. is a table showing the relationship between three variables: (1) Position of Rotatable Shaft 15, (2) Position of Rotor 72, and (3) Conduit which is in Fluid Communication with Conduit 26 of FIG. 1;

FIG. 6 is a side elevational view of a cam-shaft assembly of the timer mechanism of the washing machine of FIG. 1;

FIG. 7 is a side elevational view of the cam-shaft assembly of FIG. 6, with a lever and a switch of the timer mechanism shown operatively interfacing with the cam-shaft assembly;

FIG. 8 is a view similar to FIG. 7, but showing a cam disk of the cam-shaft assembly being positioned in a different position as compared to its position in FIG. 7;

FIG. 9 is an exploded perspective view of a second embodiment of a valve assembly which is used in the washing machine of FIG.1, with the timer mechanism shown schematically having a shaft which interfaces with the second embodiment of the valve assembly;

FIG. 10 is a side elevational view of a seal of the valve assembly of FIG. 9;

FIG. 11 is a cross sectional view taken along the lines 11—11 of FIG. 10 as viewed in the direction of the arrows;

FIGS. 12, 13 and 14 are side elevational views of the valve assembly of FIG. 9 showing the water flow therethrough when the rotor is located at various valve positions;

FIG. 15 is a table showing the relationship between three variables: (1) Position of Rotatable Shaft 15, (2) Position of Rotor 142, and (3) Conduit which is in Fluid Communication with Conduit 26 of FIG. 1;

FIG. 16 is an exploded perspective view of a third embodiment of a valve assembly which is used in the washing machine of FIG.1, with a timer mechanism shown schematically having a shaft which interfaces with the third embodiment of the valve assembly;

FIG. 17 is an elevational view of a housing of the valve assembly of FIG. 16;

FIGS. 18 and 19 are elevational views of the valve assembly of FIG. 16 showing the water flow therethrough when the rotatable valve member is shown located at various valve positions, with the cover of the valve assembly shown removed for clarity of description; and FIG. 20 is a table showing the relationship between three variables: (1) Position of Rotatable Shaft 15, (2) Position of Rotatable Valve Member 196, and (3) Conduit which is in Fluid Communication with Conduit 26 of FIG. 1.

DETAILED DESCRIPTION OF THE PREFERRED EMBODIMENTS

While the invention is susceptible to various modifications and alternative forms, specific embodiments thereof have been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown a schematic of an automatic washing machine 10 which incorporates the features of the present invention therein. Automatic washing machine 10 includes a main machine controller 12 electrically connected through a signal line 16 to a timer mechanism 14. One controller 12 which may be used is a washing machine timer available from Mallory Controls of Indianapolis, Ind. as model no. M520.

Timer mechanism 14 is electrically connected through a signal line 24 to a water valve 22. Water valve 22 is in fluid communication with a main water line. Timer mechanism 14 has a rotatable shaft 15 which is mechanically connected to a valve assembly 18. Rotatable shaft 15 is positionable at one of a plurality of positions by rotation in the direction indicated by arrow 17.

Valve assembly 18 is in fluid communication with water valve 22 through conduit 26. Moreover, valve assembly 18 is in fluid communication with a wash tub 28 through conduit 38. Valve assembly 18 is also in fluid communication with wash tub 28 through a conduit 30, a first dispenser compartment 32 and a conduit 40. Valve assembly 18 is further in fluid communication with wash tub 28 through conduit 42, a second dispenser compartment 34 and a conduit 44. Valve assembly 18 is still further in fluid communication with wash tub 28 through a conduit 46, a third dispenser compartment 36 and a conduit 48.

Figure 2:
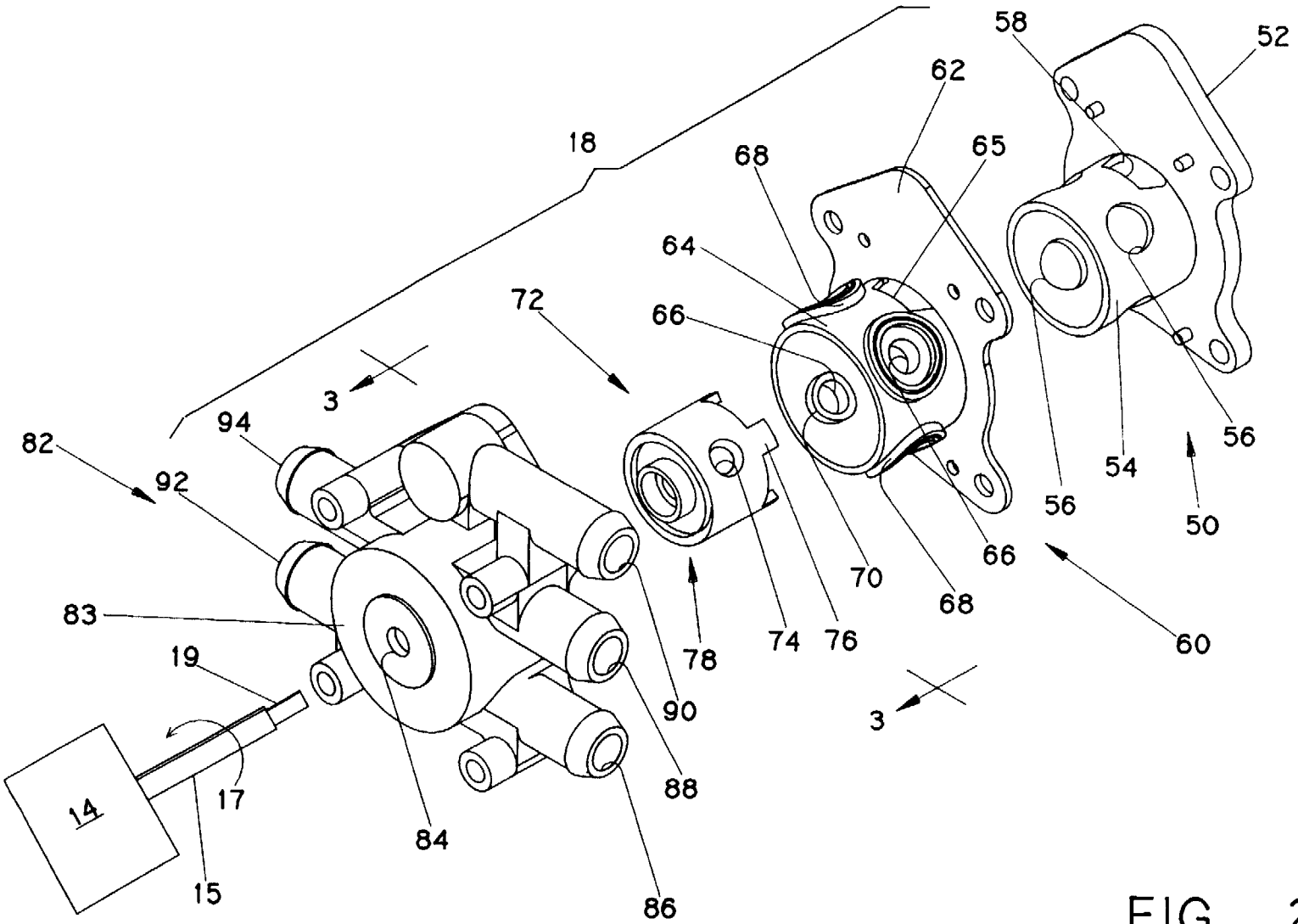
FIG. 2 is an exploded perspective view of a first embodiment of a valve assembly which is used in the washing machine of FIG. 1, with a timer mechanism shown schematically having a shaft which interfaces with the first embodiment of the valve assembly.

Referring now to FIGS. 2, 3 and 4, there is shown a first embodiment of the valve assembly 18 of the present invention. Valve assembly 18 includes a cover 50, a gasket 60, a rotatable valve member in the form of a rotor 72 and a housing 82. Cover 50 includes a flange 52 and a cylindrical mounting member 54 extending therefrom. Cylindrical mounting member 54 includes a number of first apertures 56 defined therein. Cylindrical mounting member 54 also has a water entrance 58 defined therein.

Gasket 60 includes a flange 62 and a cylindrically shaped seal 64 extending therefrom. Cylindrically shaped seal 64 has a number of second apertures 66 and a water entrance 65 defined therein. Cylindrically shaped seal 64 also has an outer lip 68 surrounding the exterior of the second apertures 66, and an inner lip 70 surrounding the interior of each of the second apertures 66. Gasket 60 is made of a flexible material such as ethylene propylene (EP) rubber.

Rotor 72 includes a third aperture 74 and a key void 80 (see FIGS. 3 and 4) defined therein. The key void 80 rotates with a key 19 which is defined in an end portion of the rotatable shaft 15 (see FIG. 2). Rotor 72 also has a number of feet 76 and a collar 78 extending therefrom.

Housing 82 includes a cylindrical body 83 having a shaft void 84 defined therein. Housing 82 also has a water inlet port 90 in fluid communication with the main water line. Housing 82 further includes a first water outlet port 92, a second water outlet port 94, a third water outlet port 88 and a fourth water outlet port 86.

After assembling valve assembly 18, cylindrical mounting member 54 is positioned within cylindrically shaped seal 64 such that flange 52 contacts flange 62. Cylindrical mounting member 54 is further positioned within cylindrically shaped seal 64 such that first apertures 56 align with second apertures 66, and inner lips 70 extend through first apertures 56. Rotor 72 is positioned within cylindrical mounting member 54). Cylindrical mounting member 54 and cylindrically shaped seal 64 are positioned in cylindrical body 83 of housing 82 such that cylindrically shaped seal 64 is interposed between cylindrical mounting member 54 and housing 82, and outer lips 68 contact housing 82 to form a seal therebetween. Cylindrical mounting member 54 and cylindrically shaped seal 64 are further positioned in cylindrical body 83 such that first apertures 56 and second apertures 66 align with first water outlet port 92, second water outlet port 94, third water outlet port 88 and fourth water outlet port 86. The flange 52 of cover 50 is secured to housing 82. It should also be understood that water entrance 58 of cylindrical mounting member 54 and water entrance 65 of cylindrically shaped seal 64 align with water inlet port 90 when cylindrical mounting member 54 and cylindrically shaped seal 64 are positioned within cylindrical body 83.

Rotor 72 is positioned within cylindrical mounting member 54 so that inner lips 70 of gasket 60 contact rotor 72 to form a seal therebetween. Rotatable shaft 15 is inserted through shaft void 84 and secured to rotor 72 by inserting the key 19 into key void 80 (see FIGS. 3 and 4). Timer mechanism 14 rotates rotatable shaft 15 to a first shaft position, a second shaft position, a third shaft position and a fourth shaft position. In turn, rotor 72 is rotated to a first valve position, a second valve position, a third valve position and a fourth valve position. In FIG. 3, rotor 72 is positioned within cylindrical mounting member 54 at the first valve position, while in FIG. 4 the rotor is shown positioned in cylindrical mounting member 54 at the second valve position.

It should be understood that when rotatable shaft 15 is positioned at the first shaft position and rotor 72 is positioned at the first valve position, aperture 74 aligns with one of first apertures 56, and with second water outlet port 94. Therefore, when rotor 72 is positioned at the first valve position a flow of water is enabled from water inlet port 90 to second water outlet port 94. However, a flow of water is disabled from water inlet port 90 to first water outlet port 92, third water outlet port 88 and fourth water outlet port 86. Therefore, when rotatable shaft 15 is at the first shaft position and rotor 72 is at the first valve position, a flow of water through conduit 26 (see FIG. 1) into water inlet port 90, as indicated by arrows 98, passes through water entrance 65 and water entrance 58, and enters cylindrical body 83. Once the water flow enters cylindrical body 83 it exits valve assembly 18 through second water outlet port 94. Once the water flow exits valve assembly 18 through second water outlet port 94, it travels through conduit 30 (see FIG. 1) to first dispenser compartment 32, then through conduit 40 to wash tub 28.

Rotating rotatable shaft 15 in the direction indicated by arrow 17 to the second shaft position, rotates rotor 72 to the second valve position. When rotor 72 is at the second valve position, third aperture 74 aligns with one of first apertures 56, and first water outlet port 92. As shown in FIG. 4, at the second valve position a flow of water is enabled from water inlet port 90 to first water outlet port 92. However, a flow of water is disabled from water inlet port 90 to second water outlet port 94, third water outlet port 88 and fourth water outlet port 86. As a result, a flow of water through conduit 26 (see FIG. 1) into water inlet port 90, as indicated by arrows 100 in FIG. 4, passes through water entrance 65 (see FIG. 2) and water entrance 58 (see FIG. 2), and enters cylindrical body 83. Once the water flow enters cylindrical body 83, it exits valve assembly 18 through first water outlet port 92. After exiting valve assembly 18, the water flow travels through conduit 38 to wash tub 28 (see FIG. 1).

Now referring to FIG. 5, there is shown a table setting forth the various positions for rotatable shaft 15 and rotor 72, as well as the fluid communication relationships between the various conduits of washing machine 10. In particular, the table sets fourth which conduit, i.e. conduit 30, 38, 42 or 46 (see FIG. 1), is in fluid communication with conduit 26 (see FIG. 1) as a function of rotatable shaft 15 positions and rotor 72 positions. As indicated in FIG. 5, a single conduit, i.e. conduit 30, 38, 42 or 46, is in fluid communication with conduit 26 at certain positions of rotatable shaft 15 and rotor 72.

Timer mechanism 14 receives electrical signals from controller 12 to synchronize the operation of valve assembly 18 with the various cycles of washing machine 10. Based upon the signals received from controller 12, timer mechanism 14 controls the rotation of rotatable shaft 15, and thus controls the positioning of the rotor 72 from one valve position to another (e.g. from the first valve position to the second valve position). One multiple cam timer that can be utilized in the present invention is available from Mallory Controls of Indianapolis Ind. as model no. M123.

As shown in FIG. 6, the motorized multiple cam timer includes a cam-shaft assembly 102. Cam-shaft assembly 102 includes a first cam disk 106 having a first cam profile, a second cam 108 having a second cam profile, a third cam 110 having a third cam profile, and a fourth cam 112 having a fourth cam profile. The aforementioned cam profiles are represented by notch 114 in FIGS. 6, 7 and 8. First cam disk 106, second cam disk 108, third cam disk 110 and fourth cam disk 112 are mounted on the rotatable shaft 15.

Each cam is engaged by a lever 116 for reading cam profile 114 as shown in FIGS. 7 and 8. Lever 116 is operatively linked to a switch 118 for controlling the on/off function of a motor (not shown) that rotates rotatable shaft 15. Therefore, the appropriate positioning of rotatable shaft 15, and thus the rotatable valve member (i.e. rotor 72) of valve assembly 18, is controlled by cam profile 114 of the aforementioned cams.

Alternatively, a motorized single cam timer having a cam disk with four cam profiles thereon can be used in the present invention. Note that all four cam profiles in this type of cam timer are positioned on the surface of one side of the cam disk. Using such a single cam timer consumes less space in the washing machine cabinet, decreases the cost of manufacturing, and requires less moving parts.

Now referring to FIG. 9, there is shown a second embodiment of a valve assembly 120 of the present invention. The second embodiment of valve assembly 120 provides the same function as the first embodiment of the valve assembly 18, and thus can be substituted for valve assembly 18 for use in washing machine 10.

Valve assembly 120 includes a housing 122, a cylindrical mounting member 136, a rotor 142, four seals 154, and a cover 150 having a shaft void 152 defined therein. Housing 122 includes a cylindrical body 132 having a first water outlet port 124, a second water outlet port 126, a third water outlet port 128 and a fourth water outlet port 131 (see FIG. 12) extending therefrom. Housing 122 also includes a water inlet port 123 and an interior chamber 134.

Cylindrical mounting member 136 includes four sealing segments 138. Each of sealing segments 138 includes only one first aperture 140 defined therein. Cylindrical mounting member 136 also includes a number of dogs 162 extending therefrom. Dogs 162 ensure proper alignment of first apertures 140 with water outlet ports 124,126,128 and 131 when cylindrical mounting member is positioned in cylindrical body 132.

FIGS. 10 and 11 show seals 154 in more detail. The seals 154 each have an aperture 160 defined therein. An outer lip 156 surrounds the exterior side of the second aperture 160, and an inner lip 158 surrounds the interior side of the second aperture. Seals 154 are made of a flexible material such as ethylene propylene (EP) rubber.

Referring again to FIG. 9, rotor 142 includes a third aperture 146 and a forth aperture 148 defined therein. Rotor 142 also has a key void 144 defined therein which mates with key 19 of shaft 15.

Seals 154 are mounted on sealing segments 138 of cylindrical mounting member 136. Inner lip 158 of each seal 154 extends through each first aperture 140 in a friction fit manner. Cylindrical mounting member 136, having seals 154 mounted thereon, is positioned in interior chamber 134 of cylindrical body 132 such that each outer lip 156 contacts an interior sidewall of housing 122 to form a seal therebetween. Rotor 142 is positioned within cylindrical mounting member 136 so that inner lips 158 contact and form a seal against rotor 142. Rotatable shaft 15 is inserted through shaft void 152 and secured to rotor 142.

Turning now to FIGS. 12, 13 and 14, alignment of third apertures (see FIG. 9) or fourth apertures (see FIG. 9) with water outlet port(s) 124, 126, and 131 is depicted by water flow(s) exiting therefrom which are indicated by arrows 166, 168 and 170. As shown, rotor 142 is rotated in a direction indicated by arrow 166 to various positions which align third aperture 146 (not shown) or fourth aperture 148 (not shown) with water outlet port(s) 124,126, 128, 131. For example, rotatable shaft 15 rotates rotor 142 from a position where third aperture 146 (see FIG. 9) is aligned with water outlet port 126 as shown in FIG.12, to a position where fourth aperture 148 is aligned with water outlet port 124, and third aperture 146 (see FIG. 9) is not aligned with any water outlet ports as shown in FIG. 13. Rotatable shaft 15 also rotates rotor 142 to a position where third aperture 146 and fourth aperture 148 are simultaneously aligned with two water outlet ports as shown in FIG. 14. In particular, rotatable shaft 15 rotates rotor 142 to a position where third aperture 146 is aligned with water outlet port 131 and fourth aperture 148 is aligned with water outlet port 124. The ability to have water exit through two water outlet ports allows valve assembly 120 to simultaneously direct a flow of water to a first dispenser compartment and a second dispenser compartment.

Now referring to FIG. 15, there is shown a table setting fourth the various positions for rotatable shaft 15 and rotor 142, as well as the fluid communication relationships between the various water conduits of washing machine 10. In particular, table sets fourth which conduit, i.e. conduit 30, 38, 42 or 46 (see FIG. 1), or which combination of conduits are in fluid communication with conduit 26 (see FIG. 1) as a function of rotatable shaft 15 positions and rotor 142 positions. As indicated in FIG. 15, more than a single conduit may be in fluid communication with conduit 26 at certain positions of rotatable shaft 15 and rotor 142.

Now referring to FIG. 16, there is shown a third embodiment of a valve assembly 172 of the present invention. The third embodiment of valve assembly 172 provides the same function as the first embodiment of the valve assembly 18, and thus can be substituted for valve assembly 18 for use in the washing machine 10.

Valve assembly 172 includes a housing 174, a cover 204 and a rotatable valve member 196. As shown in FIGS. 16 and 17, housing 174 defines a first chamber 184 and a second chamber 186. Housing 174 further includes a water inlet port 176 connected to second chamber 186. Housing 174 additionally includes a first water outlet port 178, a second water outlet port 180, a third water outlet port 182 and a fourth water outlet port 183 all in fluid communication with first chamber 184. Housing 174 further includes an interior side wall 188, and a plurality internal receptacles 190. Each internal receptacle defines a guide surface 194 and forms a respective end portion 192 of first water outlet port 178, second water outlet port 180, third water outlet port 182 and fourth water outlet port 183.

The rotatable valve member 196 includes a cylindrical member 198 having a plurality of projections 200 secured thereto which extend outwardly therefrom. Each of the projections 200 include a substantially cylindrical contact tip 202. Cylindrical member 198 also defines a communication region 212. The communication region 212 is defined by an area bounded by two adjacent projections 200, the interior sidewall 188 and the periphery of cylindrical member 198 where the distance between two adjacent projections 200 greater than the distance between any other two adjacent projections 200 as shown in FIG. 18.

Rotatable valve member 196 is positioned in first chamber 184 of housing 174 such that cylindrical member 198 and projections 200 contact guide surface 194 to form a seal therebetween (see FIGS. 18 and 19). Rotatable valve member 196 is further positioned in first chamber 184 such that contact tips 202 contact interior side wall 188 to form a seal therebetween. Cover 204 is secured to housing 174 such that cylindrical member 198 and projections 200 form a seal against cover 204. (Note that cover 204 is removed in FIGS. 18 and 19 for clarity of description.)

Any water outlet port (e.g. 178, 180,182 and 183) which is located outside of the communication region 212 is isolated from fluid communication with water inlet port 176. Thus, it should be understood that in order for a flow of water to exit valve assembly 172 via first water outlet port 178, second water outlet port 180, third water outlet port 182 or fourth water outlet port 183, one or more of these outlet ports must be located in the communication region 212. Note that the communication region 212 is movable in response to movement of rotatable valve member 196.

Rotatable shaft 15 is inserted through a shaft void 205 defined in cover 204 such that key 19 is positioned in a key void 208 defined in cylindrical member 198. Thus, rotatable shaft 15 is able to rotate rotatable valve member 196 in the direction indicated by arrow 17 (see FIG. 16).

FIG. 18 shows a water flow, as indicated by arrow 206, entering water valve assembly 172 via water inlet port 176 while rotatable valve member is positioned at first valve position. As shown by arrow 206 in FIG. 18, the only water outlet port in fluid communication with the flow of water 206 is water outlet port 182. Thus, the flow of water 206 flows from water inlet port 176 to inlet port 182 as shown in FIG. 18. However, rotating rotatable valve member 196 in the direction indicated by arrow 210 to the second valve position allows the water flow to travel from the water port 176, through second chamber 186 (see FIG. 16) (beneath rotatable valve member 196 as indicated by the arrow 206 shown in phantom in FIG. 19), and then enter first chamber 184 via communication region 212 (see FIG. 16). Once the flow of water 206 enters first chamber 184, the flow of water 206 simultaneously exits valve assembly 172 via water outlet port 180 and water outlet port 182 since both of these outlet ports are located within the communication region 212 (see FIG. 16).

Now referring to FIG. 20, there is shown a table setting fourth the various positions for rotatable shaft 15 and rotatable valve member 196, as well as relationships between the various water conduits of washing machine 10. In particular the table sets fourth which conduit, i.e. conduit 30, 38, 42 or 46 (see FIG.1), or which combination of conduits are in fluid communication with conduit 26 (see FIG.1) as a function of rotatable shaft 15 positions and rotatable valve member 196 positions. As indicated in FIG. 20, more than one conduit may be in fluid communication with conduit 26 at certain positions of rotatable shaft 15 and rotatable valve member 196.

While the invention has been illustrated and described in detail in the drawings and foregoing description, such illustration and description is to be considered as exemplary and not restrictive in character, it being understood that only the preferred embodiments have been shown and described and that all changes and modifications that come within the spirit of the invention are desired to be protected.

What is claimed is:

1. An apparatus for diverting a flow of water in a washing machine having a first dispenser compartment, comprising:

a valve assembly including a housing and a rotatable valve member, said housing having (1) a water inlet port defined therein which is connected to a main water line, and (2) a first water outlet port defined therein which is connected to said first dispenser compartment, said rotatable valve member (1) disabling a flow of water from said water inlet port to said first water outlet port when said rotatable valve member is positioned at a first valve position, and (2) enabling said flow of water from said water inlet port to said first water outlet port when said rotatable valve member is positioned at a second valve position; and a timer mechanism having a rotatable shaft which is positionable at a first shaft position and a second shaft position, said rotatable valve member being positioned at said first valve position when said rotatable shaft is positioned at said first shaft position, and further said rotatable valve member being positioned at said second valve position when said rotatable shaft is positioned at said second shaft position.

2. The apparatus of claim 1, wherein:

said washing machine has a second dispenser compartment, said housing has a second water outlet port defined therein which is connected to said second dispenser compartment, and said rotatable valve member enables said flow of water from said water inlet port to said first and second water outlet ports when said rotatable valve member is positioned at said second valve position.

3. The apparatus of claim 1, wherein said rotatable shaft is secured to said rotatable valve member.

4. The apparatus of claim 1, wherein:

said washing machine further has a wash tub, and said first dispenser compartment is connected to said wash tub.

5. The apparatus of claim 1, wherein:

said timer mechanism includes a first cam having a first cam profile, and said rotatable shaft is controlled by said first cam profile to assume said first shaft position.

6. The apparatus of claim 5, wherein:

said timer mechanism includes a second cam having a second cam profile, and said rotatable shaft is controlled by said second cam profile to assume said second shaft position.

7. The apparatus of claim 1, wherein:

said valve assembly further includes a cylindrical mounting member and a seal, said cylindrical mounting member is positioned within said housing, said seal is interposed between said cylindrical mounting member and said housing, and said rotatable valve member includes a rotor which is positioned within said cylindrical mounting member.

8. The apparatus of claim 7, wherein:

said cylindrical mounting member has a number of first apertures defined therein, said seal has a number of second apertures defined therein which align with said first apertures when said seal is interposed between said cylindrical mounting member and said housing, and said rotor has a third aperture defined therein, wherein said third aperture is aligned with one of said first apertures of said cylindrical mounting member when said rotatable valve member is at said second valve position.

9. The apparatus of claim 8, wherein said rotor is secured to said rotatable shaft.

10. The apparatus of claim 8, wherein:

said seal includes a plurality of sealing segments, and each of said plurality of sealing segments includes only one second aperture defined therein.

11. The apparatus of claim 10, wherein:

said rotor has a fourth aperture defined therein, wherein said fourth aperture is aligned with another of said first apertures of said cylindrical mounting member when said rotatable valve member is located at said second valve position.

12. The apparatus of claim 8, wherein:

said seal includes a cylindrically shaped member, and said cylindrically shaped member includes a plurality of second apertures defined therein.

13. The apparatus of claim 8, wherein:

when said third aperture aligns with said one of said first apertures, said flow of water is enabled from said water inlet port to said first water outlet port.

14. The apparatus of claim 1, wherein:

said housing includes a first chamber and a second chamber, said water inlet port is connected to said first chamber, said first water outlet port is connected to said second chamber, said rotatable valve member is positioned in said second chamber so as to disable said flow of water from said water inlet port to said first water outlet port when said rotatable valve member is positioned at said second valve position.

15. The apparatus of claim 14, wherein said rotatable valve member includes:

a cylindrical member, and a plurality of projections secured to said cylindrical member and extending outwardly therefrom.

16. The apparatus of claim 15 wherein said cylindrical member is secured to said rotatable shaft.

17. The apparatus of claim 15, wherein:

said housing includes an interior sidewall, and each of said plurality of projections contact said interior sidewall.

18. The apparatus of claim 17, wherein:

each of said plurality of projections include a contact tip, and said contact tip has a substantially cylindrical shape.

19. The apparatus of claim 17, wherein:

said housing includes an internal receptacle which forms an end portion of said water outlet port, and said internal receptacle defines a guide surface which said rotatable valve member sealingly contacts.

20. The apparatus of claim 1, wherein a water valve is interposed between said main water line and said water inlet port.

21. An automatic washing machine, comprising:

a wash tub;

a dispenser compartment which is connected to said wash tub;

a valve assembly including a housing and a rotatable valve member, said housing having (1) a water inlet port defined therein which is connected to a main water line, and (2) a first water outlet port defined therein which is connected to said dispenser compartment, said rotatable valve member (1) disabling a flow of water from said water inlet port to said first water outlet port when said rotatable valve member is positioned at a first valve position, and (2) enabling said flow of water from said water inlet port to said first water outlet port when said rotatable valve member is positioned at a second valve position; and a timer mechanism having a rotatable shaft which is positionable at a first shaft position and a second shaft position, said rotatable valve member being positioned at said first valve position when said rotatable shaft is positioned at said first shaft position, and further said rotatable valve member being positioned at said second valve position when said rotatable shaft is positioned at said second shaft position.

* * * * *